US011015346B2

(12) United States Patent
Ulici

(10) Patent No.: US 11,015,346 B2
(45) Date of Patent: May 25, 2021

(54) PREFABRICATED TILING SYSTEM AND METHOD

(71) Applicant: Ioan Ulici, Burnaby (CA)

(72) Inventor: Ioan Ulici, Burnaby (CA)

( * ) Notice: Subject to any disclaimer, the term of this patent is extended or adjusted under 35 U.S.C. 154(b) by 0 days.

(21) Appl. No.: 15/700,047

(22) Filed: Sep. 8, 2017

(65) Prior Publication Data

US 2019/0078329 A1 Mar. 14, 2019

(51) Int. Cl.

| | |
|---|---|
| ***E04C 2/40*** | (2006.01) |
| ***E04F 13/08*** | (2006.01) |
| ***E04F 15/02*** | (2006.01) |
| ***E04F 15/08*** | (2006.01) |
| *E04B 2/00* | (2006.01) |

(52) U.S. Cl.

CPC ..... *E04C 2/40* (2013.01); *E04F 13/0862* (2013.01); *E04F 13/0878* (2013.01); *E04F 15/02188* (2013.01); *E04F 15/02194* (2013.01); *E04F 15/082* (2013.01); *E04C 2/46* (2013.01); *E04F 2201/0107* (2013.01)

(58) Field of Classification Search

CPC ..... E04C 2/40; E04C 2/46; E04F 13/0862; E04F 15/02188; E04F 15/02194; E04F 15/082

See application file for complete search history.

(56) References Cited

U.S. PATENT DOCUMENTS

| | | | | |
|---|---|---|---|---|
| 957,189 | A * | 5/1910 | CHappell | |
| 6,330,774 | B1 * | 12/2001 | Weinstein | A47B 77/022 52/314 |
| 9,297,167 | B1 | 3/2016 | Stockton | |
| 2014/0053487 | A1 * | 2/2014 | Tatari | E04F 13/09 52/386 |
| 2014/0272242 | A1 * | 9/2014 | Heiner | E04F 13/0862 428/49 |
| 2016/0236507 | A1 * | 8/2016 | Domanico | B44C 5/04 |
| 2017/0058527 | A1 | 3/2017 | Williams | |

FOREIGN PATENT DOCUMENTS

| | | |
|---|---|---|
| CN | 205950973 U | 2/2017 |

* cited by examiner

*Primary Examiner* — Patrick J Maestri

(74) *Attorney, Agent, or Firm* — Runyan Law; Charles Runyan

(57) ABSTRACT

A prefabricated tiling system includes a tiled panel assembly and a mounting adhesive configured to affix the tiled panel assembly on a planar surface. The tiled panel assembly further includes a tiling material configured to couple with a mounting substrate through the use of a tiling adhesive. The prefabricated tiling system is useful for providing a lightweight and waterproof system for applying a plurality of tiles to a planar surface with minimal equipment and technical knowledge required.

15 Claims, 4 Drawing Sheets

PREFABRICATED TILING SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of tile installation of existing art and more specifically relates to a prefabricated tiling system.

RELATED ART

Bathrooms, kitchens, laundry rooms, and other similar locations in a building often include tile surfaces. The tile surfaces are beneficial for use in these locations due to the aesthetically pleasing appearance of the tile, the generally water-resistant outer surface of the tiles and the ease of cleaning the tile surfaces. At the present time, most tile installations are performed on site, requiring skilled, experienced professionals. In addition to being costly and time consuming, the installation involves the use of many materials, usually leaving a mess to be cleared up.

Recently, consumers of mobile homes and homes with prefabricated elements, such as speculation homes (also called "spec homes"), have desired the benefits of tile surfaces. This has led builders to attempt to incorporate tile surfaces into spec homes and mobile homes. However, builders have encountered problems using tile in these environments such as construction delays while waiting for the tile surfaces to cure at the building site. In other instances, the pre-constructed tile surfaces have been damaged while being transported to the building site or upon installation at the building site.

Some consumers choose to tile various surfaces in their homes on their own. These projects can take extensive amounts of time without the proper tools and often involve lifting heavy materials. A suitable solution is desired.

U.S. Pat. No. 6,330,774 to Albert I. Weinstein relates to a prefabricated tiled panel system. The described prefabricated tiled panel system includes a system comprising a plurality of prefabricated tiled panels for installation on walls, floors and counters and intended for both interior or exterior use. Panels are selected to each include a particular segment of the overall tiled array. Thus, when all the panels are installed in a previously laid out configuration and the installation is completed, the installation displays the entire tile design without unsightly breaks. Provision is made for fastening panels to framing studs or flat surfaces. Each panel comprises a single base member made from any of a selection of materials that does not need waterproofing and any size and type of tiles. It is easy to install by any relatively unskilled person. Benefits to builders and homeowners include good quality control, due to the controlled manufacturing of the panels, low cost due to methods and materials employed, and practical low cost installation, requiring substantially less skill than that required for present day on site tiling. Also, a faster installation resulting in better scheduling and less intrusion into construction projects.

SUMMARY OF THE INVENTION

In view of the foregoing disadvantages inherent in the known tile installation art, the present disclosure provides a novel prefabricated tiling system. The general purpose of the present disclosure, which will be described subsequently in greater detail, is to provide a lightweight and waterproof system for applying a plurality of tiles to a planar surface with minimal equipment and technical knowledge required.

A prefabricated tiling system is disclosed herein. The prefabricated tiling system may include a tiled panel assembly and a mounting adhesive configured to affix the tiled panel assembly on a planar surface. The tiled panel assembly may further include a tiling material configured to couple with a mounting substrate by use of a tiling adhesive.

According to another embodiment, a method for installing a prefabricated tiling system is also disclosed herein. The method for installing a prefabricated tiling system may include providing a prefabricated tiling system including a tiled panel assembly and mounting adhesive for installation on a planar surface, preparing the planar surface for installation of at least one tiled panel assembly, applying the mounting adhesive configured to affix a first tiled panel assembly to the planar surface, aligning a second-tiled-panel-assembly in an adjoining position with the first tiled panel assembly, and applying the mounting adhesive configured to affix the second-tiled-panel-assembly to the planar surface in an adjoining position with the first tiled panel assembly.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a prefabricated tiling system, constructed and operative according to the teachings of the present disclosure.

The various embodiments of the present invention will hereinafter be described in conjunction with the appended drawings, wherein like designations denote like elements.

DETAILED DESCRIPTION

Figure 1:
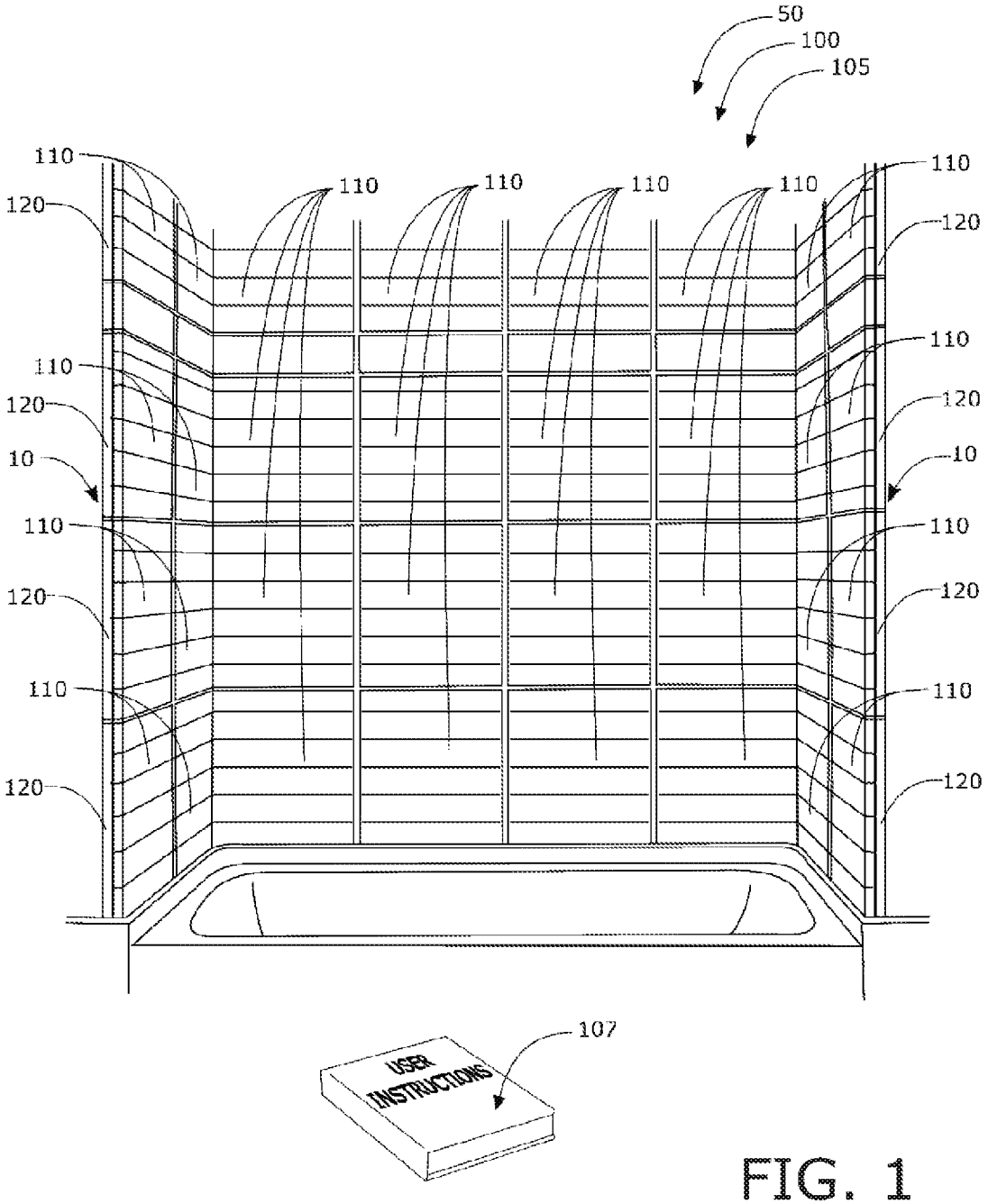
FIG. 1 is a perspective view of the prefabricated tiling system during an 'in-use' condition showing at least one tiled panel assembly installed in a bathroom setting, according to an embodiment of the disclosure.

As discussed above, embodiments of the present disclosure relate to tile installation and more particularly to a prefabricated tiling system as used to improve the process of applying a plurality of tiles to a planar surface with minimal equipment and technical knowledge required.

Generally speaking, the prefabricated tiling system may be configured as a lightweight system for applying pre-tiled panels to an interior or exterior surface. The panels may be configured in sizes ranging from approximately 3 feet by 5 feet and approximately ⅛th of an inch up to 1.5 inches in thickness. By providing larger pre-tiled panels, the system may enable a user to cover a surface with tile in much less time than the standard process of placing each individual tile one at a time. The prefabricated tiling system may not require extra hardware or specialized tools other that what is included in the system in order to install the tiled panels. The prefabricated tiling system is configured to be waterproof and mold resistant upon installation.

Each tiled panel assembly of the prefabricated tiling system may weigh less than approximately 20 lbs, which is useful for making the installation process easy while reducing the possible occurrence of a failed install or damage to the surface upon which the panels are applied. The tiled panel assemblies may be produced in custom sizes and shipped to order for the user, but may generally be produced on a standard mounting board measuring 3 by 5 feet. The panels of tiles may be installed either with a cement or glue based material. The mounting boards may even be sprayed onto the tiling material without the need for secondary tiling adhesives.

A foam backer board may be used as the mounting substrate. After getting the foam backer board glued to the tile panel, grout lines may be cut only in the tile and then grouted. The grout line grooves may be cut in nearly any size and shape configurations, depending on user preferences. The panels may be installed with cement or a glue based material to the drywall sides where foam and tiles are exposed. This may then be followed up and covered with a metal trim.

In a preferred embodiment, the prefabricated tiling system may include a thin waterproof membrane affixed to the back or surrounding sides of the mounting substrate. The waterproof membrane may feature a cloth-like configuration. This waterproof membrane may not be included on every tiled panel assembly set for installation. Instead, the waterproof membrane may be added or removed depending on the panel location and installation condition. The exact dimensions and preparation for installation may differ depending on application conditions. Other embodiments may feature a mounting substrate configured as a soft-foam, which may be used on a floor surface and grouted with silicone. This soft-foam configuration may be especially suited for applications of mosaic tiled panel assemblies.

Upon reading this specification, it should be appreciated that, under appropriate circumstances, considering such issues as user preferences, design preference, structural requirements, marketing preferences, cost, available materials, technological advances, etc., other prefabricated tiling system arrangements such as, for example, accent panels or bare drywall, etc., may be sufficient.

It should also be noted that exact installation steps and preparation measures may vary widely from situation to situation. The prefabricated tiling system may be configured for use in environments that feature little to no base preparation before install, such as bare drywall applications and bare flooring applications. In these instances, alternative cements may be applied to the application site first with a large single panel being placed into position before any sealing is completed on back or sidewall panels.

The tiled panel assemblies may be installed by use of a tongue and groove configuration, thereby making it easy for the panels to meet and stay together. Additional cements, glues, and silicone compositions may be applied in order to seal and further weatherproof the tiled panels.

Figure 2:
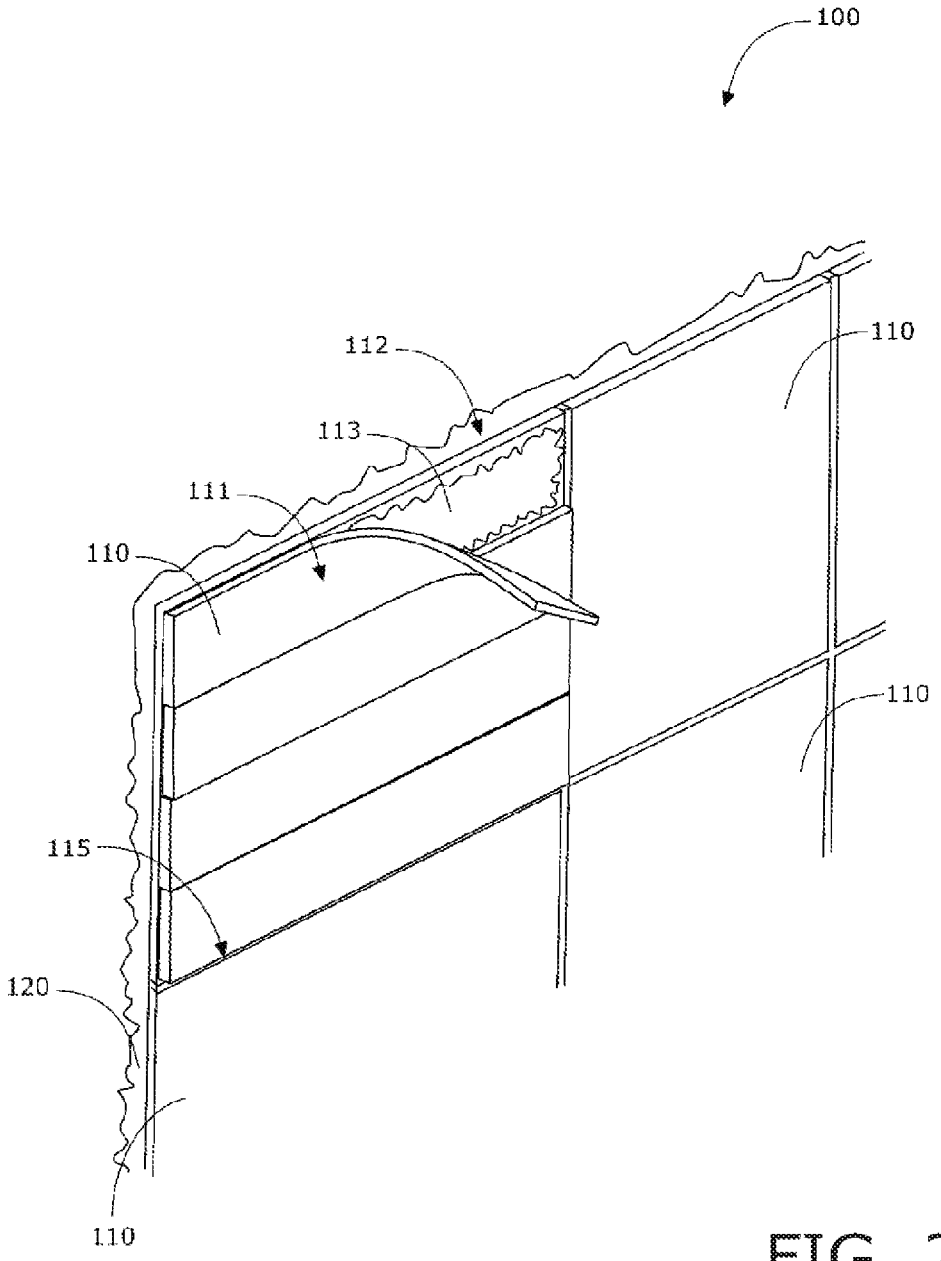
FIG. 2 is another perspective view of the prefabricated tiling system of FIG. 1 showing a close-up of a tiled panel assembly configured for installation, according to an embodiment of the present disclosure.
Figure 3:
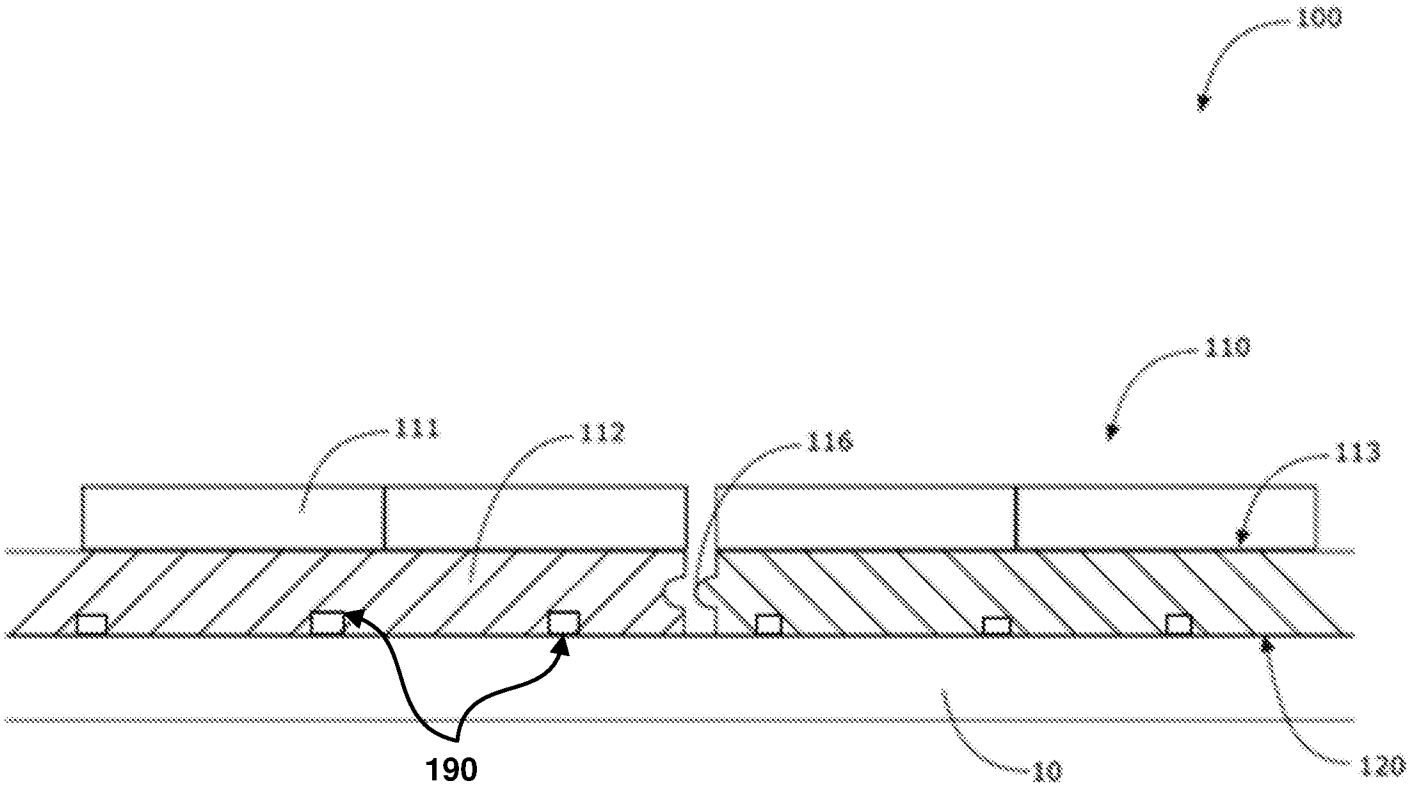
FIG. 3 is a side view of the prefabricated tiling system of FIG. 1 showing a tiled panel assembly from the side, according to an embodiment of the present disclosure.

Referring now more specifically to the drawings by numerals of reference, there is shown in FIGS. 1-3, various views of a prefabricated tiling system 100.

FIG. 1 shows a prefabricated tiling system 100 during an 'in-use' condition 50, according to an embodiment of the present disclosure. Here, the prefabricated tiling system 100 may be beneficial for use by a user to provide a lightweight and waterproof system for applying a plurality of tiles to a planar surface with minimal equipment and technical knowledge required. As illustrated, the prefabricated tiling system 100 may include a tiled panel assembly 110 for installation on a planar surface 10 and a mounting adhesive 120 for installing the tiled panel assembly 110 onto the planar surface 10. Each tiled panel assembly 110 may be installed as individual units having a plurality of tiles or other materials pre-mounted to the assembly, so as to save time and increase efficiency during the covering of a planar surface 10.

According to one embodiment, the prefabricated tiling system 100 may be arranged as a kit 105. In particular, the prefabricated tiling system 100 may further include a set of instructions 107. The instructions 107 may detail functional relationships in relation to the structure of the prefabricated tiling system 100 such that the prefabricated tiling system 100 can be used, maintained, or the like, in a preferred manner.

FIG. 2 shows the prefabricated tiling system 100 of FIG. 1, according to an embodiment of the present disclosure. As above, the prefabricated tiling system 100 may include a tiled panel assembly 110 and a mounting adhesive 120 configured for installing the tiled panel assembly 110. Each tiled panel assembly 110 may further comprise a tiling material 111, a mounting substrate 112, and a tiling adhesive 113. In addition, the tiled panel assembly 110 may also include at least one grout channel 115. The at least one grout channel 115 may be configured as an ornamental design on each tiled panel assembly 110.

FIG. 3 is a side view of the prefabricated tiling system 100 of FIG. 1, according to an embodiment of the present disclosure. As illustrated, the prefabricated tiling system 100 may include a tiled panel assembly 110 for installation on a planar surface 10 and a mounting adhesive 120 for installing the tiled panel assembly 110 onto the planar surface 10. Each tiled panel assembly 110 may comprise a tiling material 111, a mounting substrate 112, and a tiling adhesive 113. The tiled panel assembly 110 may further be configured with at least one tongue and groove fitting 116. The included tongue and groove fitting 116 may itself be configured to couple with the at least one tongue and groove fitting 116 on a second-tiled-panel-assembly to increase the efficiency of installation, sturdiness, and waterproofing of the prefabricated tiling system 100. The install side of mounting substrate 112 may include at least one discontinuation 190 configured to couple with mounting adhesive 120 as shown in FIG. 3.

Figure 4:
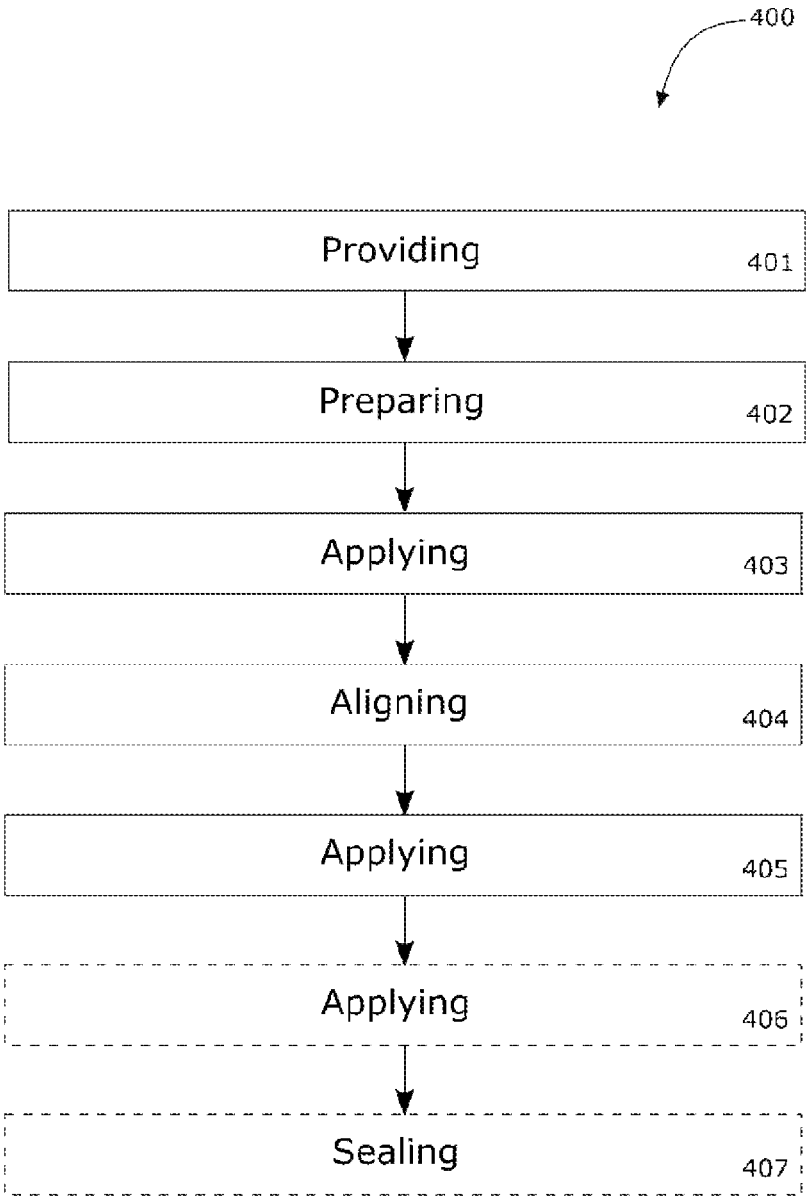
FIG. 4 is a flow diagram illustrating a method for installing a prefabricated tiling system, according to an embodiment of the present disclosure.

Referring now to FIG. 4 showing a flow diagram illustrating a method for installing 400 a prefabricated tiling system 100, according to an embodiment of the present disclosure. In particular, the method for installing 400 a prefabricated tiling system 100 may include one or more components or features of the prefabricated tiling system 100 as described above. As illustrated, the method for installing 400 a prefabricated tiling system 100 may include the steps of: step one 401, providing a prefabricated tiling system 100 for installation on a planar surface 10, the prefabricated tiling system 100 having a tiled panel assembly 110 and a mounting adhesive 120, the tiled panel assembly 110 including a tiling material 111, a mounting substrate 112, and a tiling adhesive 113, the tiling material 111 having a front side, a back side, and a depth, the mounting substrate 112 having a tiling side, an install side, and a thickness, the tiling adhesive 113 configured to affix the tiling material 111 to the mounting substrate 112, the mounting adhesive 120 configured to affix the completed tiled panel assembly 110 onto the planar surface 10; step two 402, preparing the planar surface 10 for installation of at least one tiled panel assembly 110; step three 403, applying the mounting adhesive 120 configured to affix a first tiled panel assembly 110 to the planar surface 10; step four 404, aligning a second-tiled-panel-assembly in an adjoining position with the first tiled panel assembly 110; and step five 405, applying the mounting adhesive 120 configured to affix the second-tiled-panel-assembly to the planar surface 10 in an adjoining position with the first tiled panel assembly 110.

It should be noted that step six 406 and step seven 407 are optional steps and may not be implemented in all cases. Optional steps of method for installing 400 are illustrated using dotted lines in FIG. 4 so as to distinguish them from the other steps of method for installing 400. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for prefabricated tiling system 100, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A prefabricated tiling system for installation on a planar surface, the prefabricated tiling system comprising:
- a tiled panel assembly including:
  - a tiling material having a front side, a back side, and a depth;
  - a mounting substrate constructed of foam having a tiling side, an install side, and a thickness;
  - at least one grout channel;
  - a waterproof cloth membrane removably attached to the panel making the panel waterproof;
  - and
  - a tiling adhesive;
  - and
- a mounting adhesive for installing the tiled panel assembly onto the planar surface, wherein the mounting adhesive and the tiling adhesive are the same adhesive;

wherein the tiled panel assembly is waterproof;

and wherein the at least one grout channel is disposed upon the tiling material in any size, shape, and configurations depending on the user's preferences.

2. The prefabricated tiling system of claim 1, wherein the tiled panel assembly is formed by coupling the back side of the tiling material to the tiling side of the mounting substrate with the tiling adhesive.

3. The prefabricated tiling system of claim 1, wherein the planar surface is an existing tiled surface.

4. The prefabricated tiling system of claim 1, wherein the mounting substrate is glued onto the back side of the tiling material.

5. The prefabricated tiling system of claim 1, wherein the tiled panel assembly is less than 1.5 inches in depth.

6. The prefabricated tiling system of claim 1, wherein the install side of the mounting substrate includes at least one discontinuation configured to couple with the mounting adhesive.

7. The prefabricated tiling system of claim 1, wherein the tiled panel assembly is further configured with at least one tongue and groove fitting.

8. The prefabricated tiling system of claim 7, wherein multiples of the tiled panel assembly are coupled by mating the at least one tongue and groove fitting corresponding to a first of the tiled panel assembly with the at least one tongue and groove fitting on corresponding to a second of the tiled panel assembly.

9. The prefabricated tiling system of claim 1, wherein the tiled panel assembly weighs less than 20 lbs.

10. The prefabricated tiling system of claim 1, wherein the tiling material is a material selected from the group consisting of porcelain, marble, granite, quartz, ceramic, laminate, plastic, stone, and brick.

11. The prefabricated tiling system of claim 1, wherein the tiled panel assembly is mold resistant.

12. The prefabricated tiling system of claim 1, wherein the at least one grout channel on the tiled panel assembly is repeated to form an ornamental design.

13. A prefabricated tiling system for installation on a planar surface, the prefabricated tiling system comprising:
- a tiled panel assembly including:
  - a tiling material having a front side, a back side, and a depth;
  - a mounting substrate constructed of foam having a tiling side, an install side, and a thickness; and
  - a waterproof cloth membrane removably attached to the panel making the panel waterproof;
  - and
  - a tiling adhesive;
- and
- a mounting adhesive for installing the tiled panel assembly onto the planar surface, wherein the tiled panel assembly further includes at least one grout channel;

wherein the tiled panel assembly is formed by coupling the back side of the tiling material to the tiling side of the mounting substrate with the tiling adhesive;

wherein the mounting adhesive and the tiling adhesive are the same adhesive;

wherein the planar surface is an existing tiled surface;

wherein the tiled panel assembly is waterproof;

wherein the mounting substrate is attached onto the back side of the tiling material;

wherein the tiled panel assembly is less than 1.5 inches in depth;

wherein the install side of the mounting substrate includes at least one discontinuation configured to couple with the mounting adhesive;

wherein the tiled panel assembly is further configured with at least one tongue and groove fitting;

wherein the at least one tongue and groove fitting is configured to couple with another corresponding at least one tongue and groove fitting on a second-tiled-panel-assembly;

wherein the tiled panel assembly weighs less than 20 lbs;

wherein the tiled panel assembly is mold resistant;

and wherein the at least one grout channel on the tiled panel assembly is repeated to form a functional ornamental design.

14. A method comprising the steps of:

installing a prefabricated tiling system for installation on a planar surface, the prefabricated tiling system comprising:

a tiled panel assembly including:

a tiling material having a front side, a back side, and a depth;

a mounting substrate constructed of foam, the mounting substrate having a tiling side, an install side, and a thickness; and a waterproof cloth membrane, the waterproof cloth membrane being removably attached to the panel, the waterproof cloth membrane being configured to make the panel waterproof;

and a tiling adhesive;

and a mounting adhesive for installing the tiled panel assembly onto the planar surface, wherein the tiled panel assembly further includes at least one grout channel;

wherein the tiled panel assembly is formed by coupling the back side of the tiling material to the tiling side of the mounting substrate with the tiling adhesive;

wherein the mounting adhesive and the tiling adhesive are one in the same;

wherein the planar surface is an existing tiled surface;

wherein the tiled panel assembly is waterproof;

wherein the mounting substrate is attached onto the back side of the tiling material;

wherein the tiled panel assembly is less than 1.5 inches in depth;

wherein the install side of the mounting substrate includes at least one discontinuation configured to couple with the mounting adhesive;

wherein the tiled panel assembly is further configured with at least one tongue and groove fitting;

wherein the at least one tongue and groove fitting is configured to couple with another corresponding at least one tongue and groove fitting on a second-tiled-panel-assembly;

wherein the tiled panel assembly weighs less than 20 lbs;

wherein the tiled panel assembly is mold resistant;

and wherein the at least one grout channel on the tiled panel assembly is repeated to form a functional ornamental design;

using a method comprising providing a prefabricated tiling system for installation on a planar surface, the prefabricated tiling system having a tiled panel assembly and a mounting adhesive, the prefabricated tiled panel assembly including a tiling material, a mounting substrate, and a tiling adhesive, the tiling material having a front side, a back side, and a depth, the mounting substrate having a tiling side, an install side, and a thickness, the tiling adhesive configured to affix the tiling material to the mounting substrate, the mounting adhesive configured to affix the completed tiled panel assembly onto the planar surface, wherein the mounting substrate comprises a sprayable foam;

applying the mounting adhesive configured to affix a first tiled panel assembly to the planar surface;

aligning a second-tiled-panel-assembly in an adjoining position with the first tiled panel assembly;

applying the mounting adhesive configured to affix the second-tiled-panel-assembly to the planar surface in an adjoining position with the first tiled panel assembly.

15. The method of claim 14, further comprising spray-attaching the mounting substrate onto the back side of the tiling material.

* * * * *